US007588299B2

(12) United States Patent
Yang

(10) Patent No.: US 7,588,299 B2
(45) Date of Patent: Sep. 15, 2009

(54) RAIL ASSEMBLY FOR DRAWERS

(76) Inventor: Jui-Lien Yang, 2F-2, No. 81, Sec. 1, Sintai 5$^{th}$ Rd., Sijhih City, Taipei County (TW)

( * ) Notice: Subject to any disclaimer, the term of this patent is extended or adjusted under 35 U.S.C. 154(b) by 0 days.

(21) Appl. No.: 11/905,638

(22) Filed: Oct. 3, 2007

(65) Prior Publication Data

US 2009/0091225 A1 Apr. 9, 2009

(51) Int. Cl.
*A47B 88/04* (2006.01)

(52) U.S. Cl. ..... 312/334.47; 312/333

(58) Field of Classification Search ..... 312/333, 312/334.44, 334.46, 334.47, 334.6, 334.14, 312/34.25, 334.27, 334.34; 384/21
See application file for complete search history.

(56) References Cited

U.S. PATENT DOCUMENTS 6,652,050 B2 * 11/2003 Lin ..... 312/333
6,979,066 B2 * 12/2005 Yang ..... 312/333
2004/0227438 A1 * 11/2004 Tseng et al. ..... 312/333
2007/0001562 A1 * 1/2007 Park ..... 312/333

* cited by examiner

*Primary Examiner*—Hanh V Tran

(57) ABSTRACT

A rail assembly includes a first rail and a second rail is movably received in the first rail. A third rail is movably received in the second space. A retrieving unit includes a fixed member which is fixedly located in an end of the first rail and an extension rail extends from the fixed member. A movable member is slidably connected to the extension rail and the extension rail is sized to be received in the escape space defined inward from an underside of the second rail so that the second rail is moved to a position above the extension rail. Two grooves are defined in a top on two sides of the fixed member so that the two sidewalls of the third rail are slidably engaged with the grooves.

8 Claims, 7 Drawing Sheets

RAIL ASSEMBLY FOR DRAWERS

FIELD OF THE INVENTION

The present invention relates to a rail assembly for drawers and includes an retrieving unit which allows the second and/or third rail to be moved to longer distance.

BACKGROUND OF THE INVENTION

A conventional rail assembly is widely used on drawers and generally includes a first rail which is fixed to the desk and the second and third rails are connected to the side of the drawer. The second and third rails are retractably connected to each other and both of which are movable in the first rail so that the drawer can be pulled out a desired distance and pushed back completely.

A retrieving unit is used at the end of the first rail which is operatively connected to the second rail so that when the drawer is to be pushed back, the springs of the retrieving unit automatically pulls the drawer inward into the space for the drawer. However, the conventional retrieving unit occupies a certain space and length so that the travel distance of the second and third rails is reduced. In other words, the conventional rail assembly requires longer second and third rails to allow the drawer to be pulled outward to its desired distance which usually three times of the length of the first rail.

As shown in FIG. 9 which shows a conventional rail assembly and includes a first rail (the outer rail not numbered) and a retrieving unit is fixed in an end of the first rail, the retrieving unit includes an extension portion 91. A second rail 90 and a third rail 93 are retractably received in the first rail. The second rail 90 includes a recess 92 defined in an end thereof so that when the second rail 90 is moved toward the retrieving unit, the extension portion 91 is received in the recess 92 and does not interfere the second rail 90. The second rail 90 is then weakened and cannot move to its extreme position because of the springs on two side of the extension portion 91 interfere the second rail 90. The extension portion 91 actually interferes the movement of the third rail 93.

The present invention intends to provide a rail assembly for drawer and the retrieving unit does not interfere the movement of the second and third rails so that both of the second and third rails can be completely retracted in the first rail and can be pulled outward fully.

SUMMARY OF THE INVENTION

The present invention relates to a rail assembly for drawers and the assembly comprises a substantially U-shaped first rail having two sidewalls and a first space is defined between the two sidewalls. A substantially U-shaped second rail is movably received in the first space and includes two sidewalls with a second space defined between the two sidewalls of the second rail. An escape space is defined inward from an underside of the second rail. A substantially inverted U-shaped third rail is movably received in the second space. A retrieving unit includes a fixed member which is fixedly located in an end of the first rail and received in the first space. An extension rail extends from the fixed member and located in the first space. A movable member is slidably connected to the extension rail. The extension rail is sized to be received in the escape space of the second rail so that the second rail can be moved toward the fixed member without interference. The movable member includes two upright sides and the two sidewalls of the third rail are guided by two respective insides of the two upright sides. Two grooves are defined in a top on two sides of the fixed member and the two sidewalls of the third rail are slidably engaged with the grooves.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1-1 shows an underside of the connection member;

DETAILED DESCRIPTION OF THE PREFERRED EMBODIMENT

Figure 1:
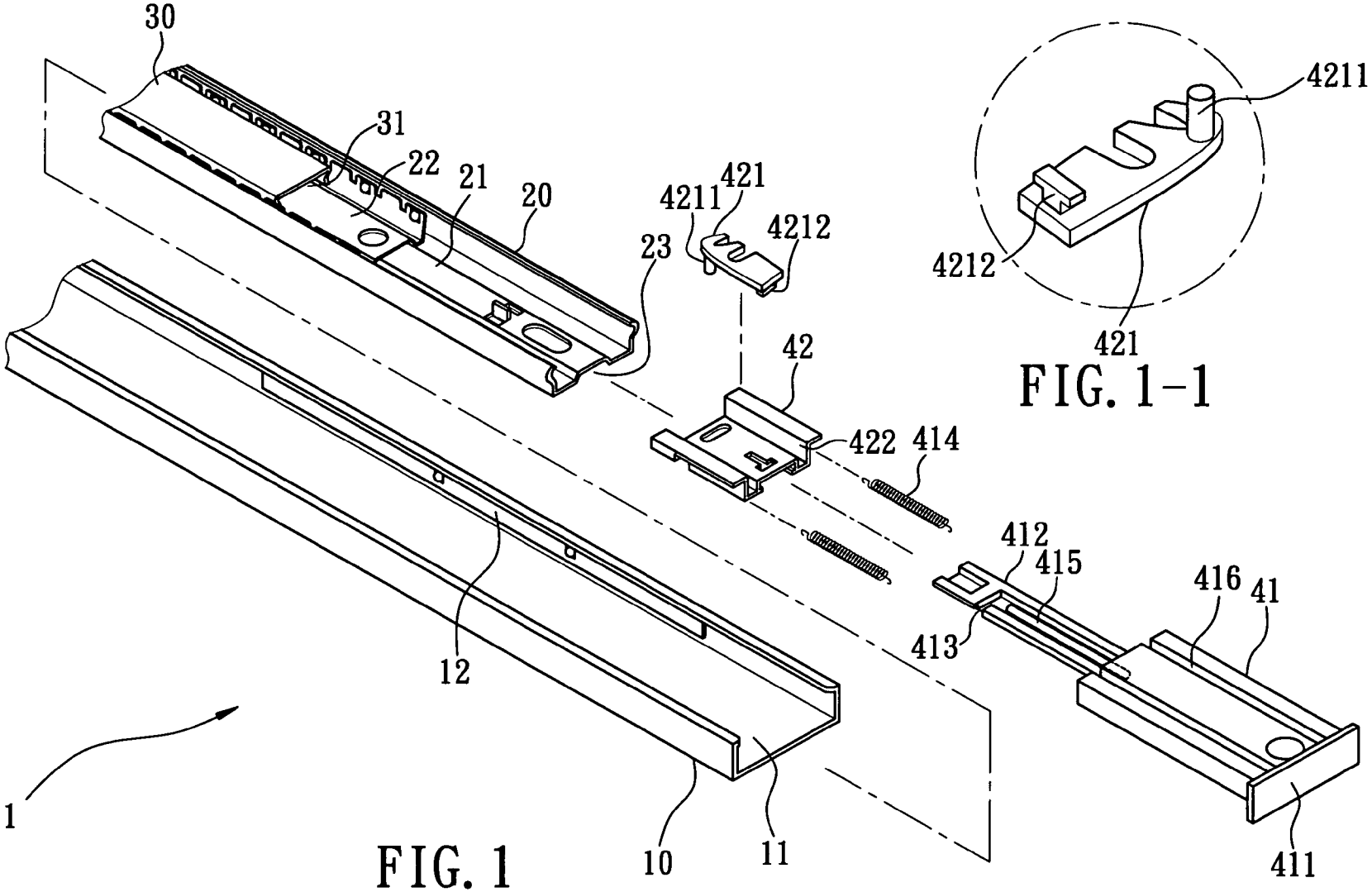
FIG. 1 is an exploded view to show the rail assembly of the present invention.
Figure 2:
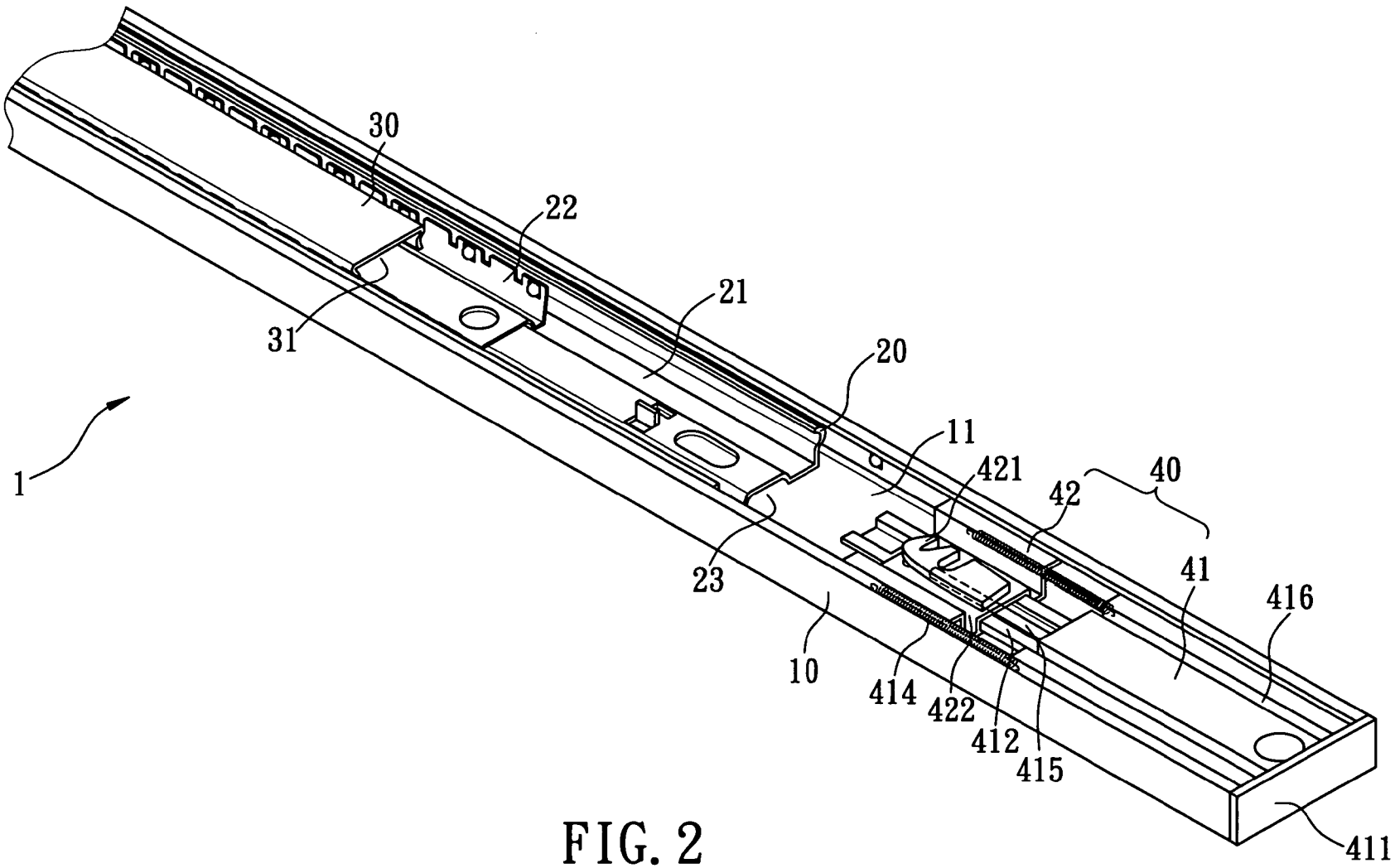
FIG. 2 is a perspective view to show the rail assembly of the present invention.

Referring to FIGS. 1 and 2, the rail assembly 1 for drawers of the present invention comprises a substantially U-shaped first rail 10 having two sidewalls and a first space 11 is defined between the two sidewalls. A plurality of rollers units 12 are connected to two insides of the two sidewalls of the first rail 10. A substantially U-shaped second rail 20 is movably received in the first space 11 and includes two sidewalls with a second space 21 defined between the two sidewalls of the second rail 20. An escape space 23 is defined inward from an underside of the second rail 20. A plurality of rollers units 22 are connected to two insides of the two sidewalls of the second rail 20. A substantially inverted U-shaped third rail 30 is movably received in the second space 21 and includes a third space 31 defined between two sidewalls of the third rail 30.

A retrieving unit 40 includes a fixed member 41 which is fixedly located in an end of the first rail and received in the first space 11. An end plate is connected to the fixed member 41 so as to seal the first space 11. An extension rail 412 extends from the fixed member 41 and located in the first space 11. A movable member 42 is slidably connected to the extension rail 412 and can be stopped by a stop rod 415 extending from the fixed member 41. A positioning slot 413 is connected to a distal end of the extension rail 412 and the movable member 42 is removably positioned on the positioning slot 413 by a connection member 421 which will be described later. Two springs 414 are located on the two sides of the fixed member 41 and connected to the movable member 42. It is noted that the extension rail 412 and the movable member 42 are sized to be received in the escape space 23 of the second rail 20, so that the second rail 20 can be moved to a position above the extension rail 412 without interference.

The movable member 42 includes two upright sides 422 and the two sidewalls of the third rail 30 are guided by two respective insides of the two upright sides 422 when the third rail 30 passes the movable member 42. Two grooves 416 are defined in a top on two sides of the fixed member 41 and the two sidewalls of the third rail 30 slidably engaged with the grooves 416 so that the third rail 30 can be received in the first space 11 of the first rail 10 completely.

The connection member 421 is located on a top of the movable member 42 and the connection member 421 includes a first protrusion 4211 and a second protrusion 4212 extending from an underside of two ends thereof. The first and second protrusions 4211, 4212 extend through two respective slots in the movable member 42 and the connection member 421 includes a curved end surface facing the third rail 30.

Figure 4:
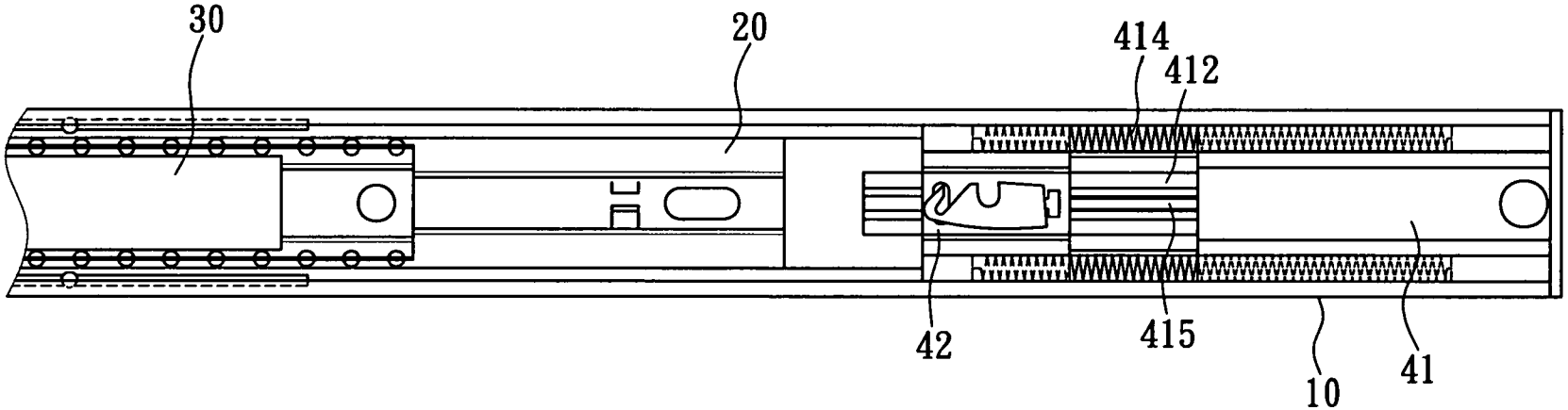
FIG. 4 is a top view to show that the second and third rails are pulled away from the movable member in first rail of the rail assembly of the present invention.
Figure 6:
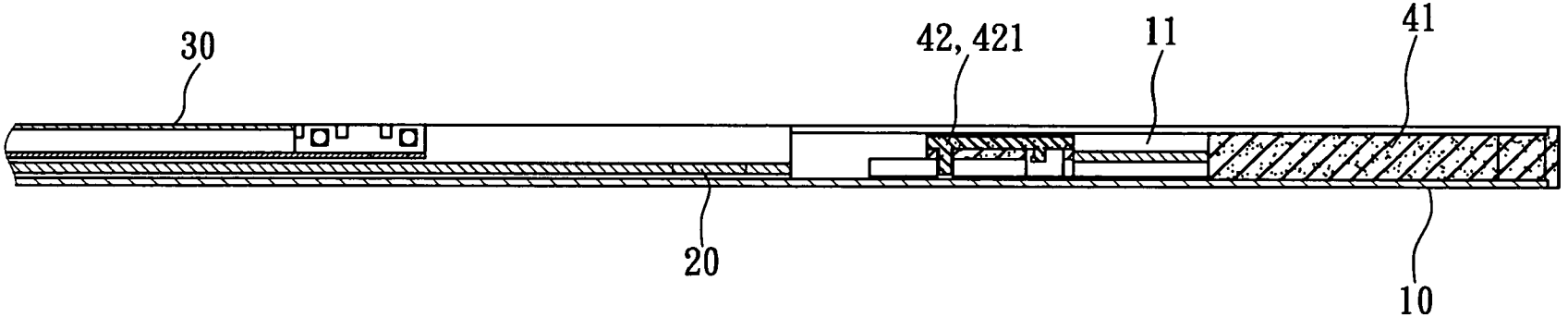
FIG. 6 is a side cross sectional view to show the status disclosed in FIG. 5.

As shown in FIGS. 4 and 6, when the drawer (not shown) is pulled to its open position, the second rail 20 is slid away from the retrieving unit 40 and the third rail 30 is slid relative to the second rail 20. The protrusion of the third rail 30 pulls the movable member 42 unit the protrusion of the third rail 30 is disengaged from the side notch of the connection member 421.

Figure 3:
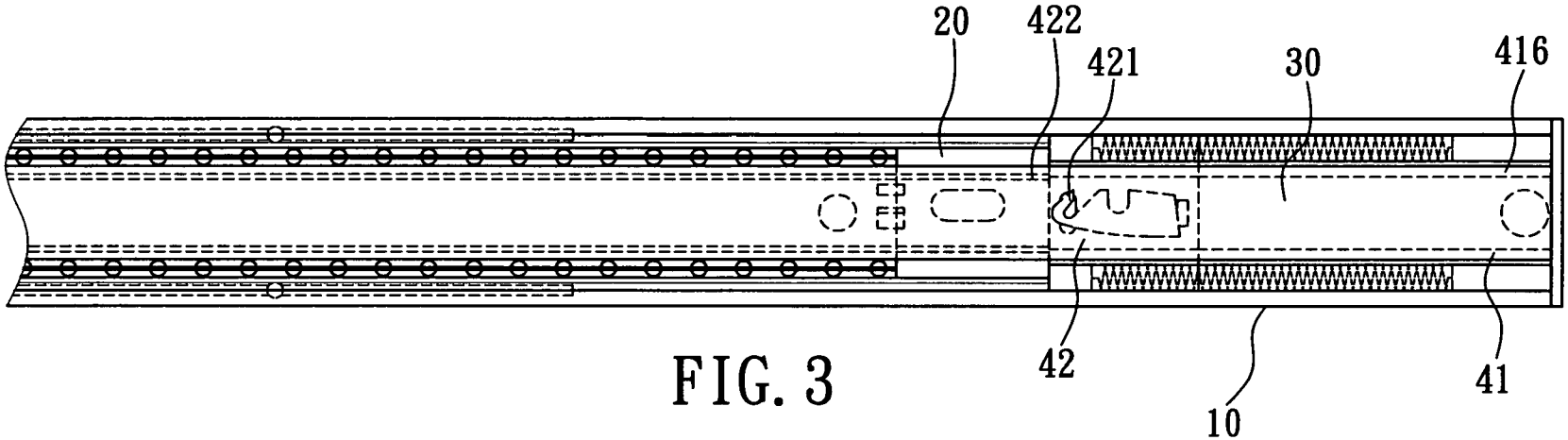
FIG. 3 is a top view to show that the second and third rails are received in the first rail of the rail assembly of the present invention.
Figure 5:
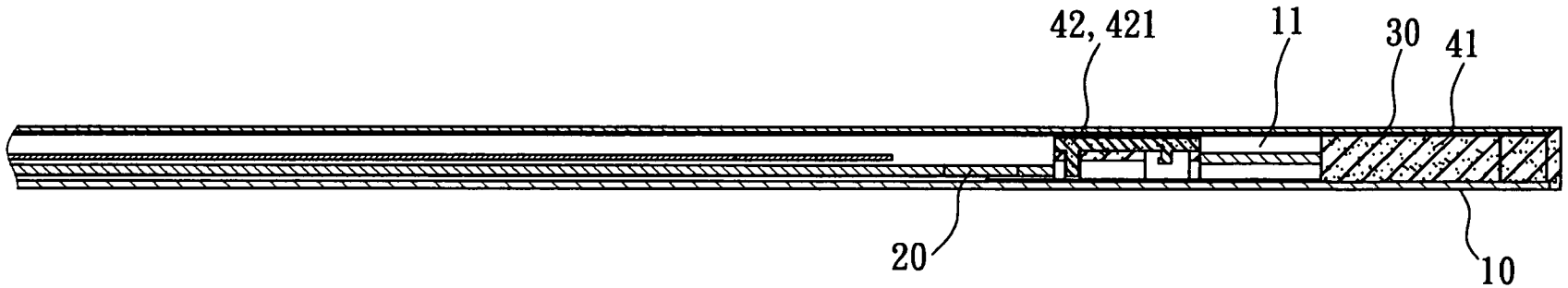
FIG. 5 is a side cross sectional view to show the status disclosed in FIG. 4.

As shown in FIGS. 3 and 5, when the drawer is pushed to its closed position, the second rail 20 is moved toward the retrieving unit 40 and the extension rail 412 is received in the escape space 23, so that the second rail 20 can be moved to an end of the fixed member 41. The two sidewalls of the third rail 30 are guided by the two upright sides 422 of the movable member 42 and slidably engaged with the grooves 416. The third rail 30 includes a protrusion (not shown) extends from its bottom and is able to move along the curved end surface to be slightly engaged with one of the two notches in one side of the connection member 421 to pivot the connection member 421. By the connection member 421, the third rail 30 can be moved with the movable member 42 when the drawer (not shown) is pushed to its closed position.

Therefore, the third rail 30 can be moved to the very end of the fixed member 41. The springs 414 help the user to pull the movable member 42 so that the drawer automatically moves to its closed position.

Figure 7:
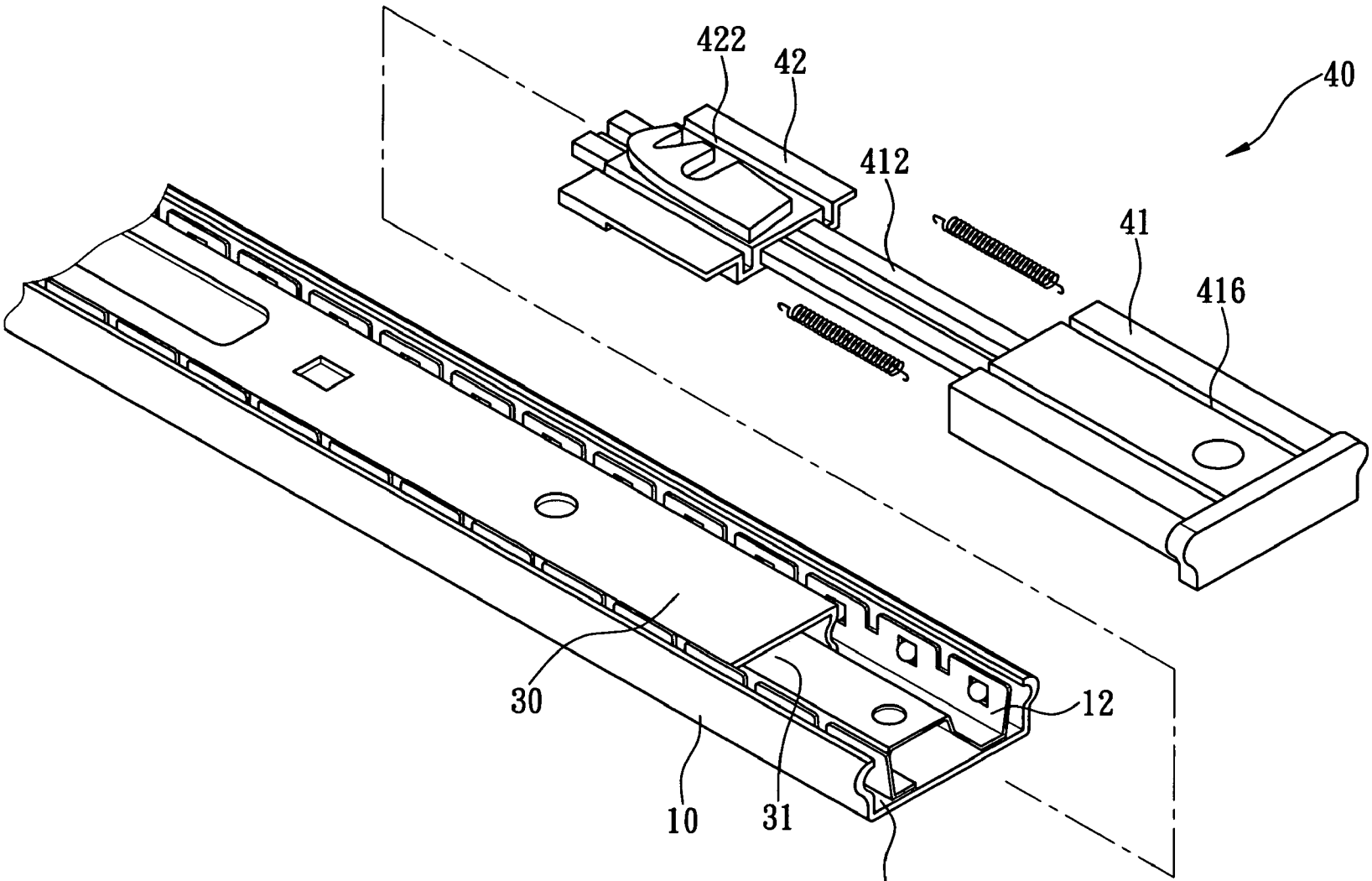
FIG. 7 is an exploded view to show another embodiment of the rail assembly of the present invention.
Figure 8:
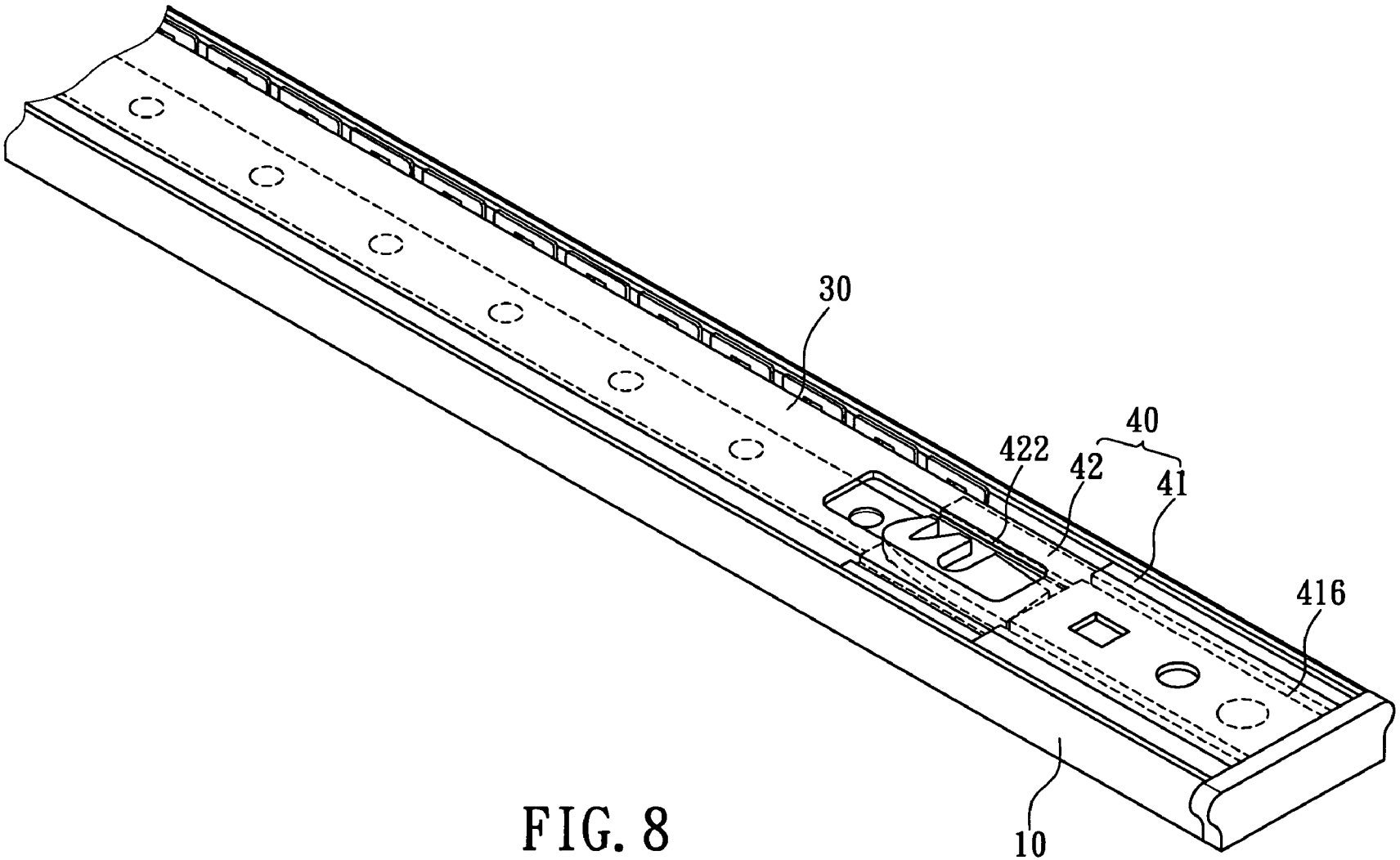
FIG. 8 is a perspective view to show the rail assembly of the present invention shown in FIG. 7.
Figure 9:
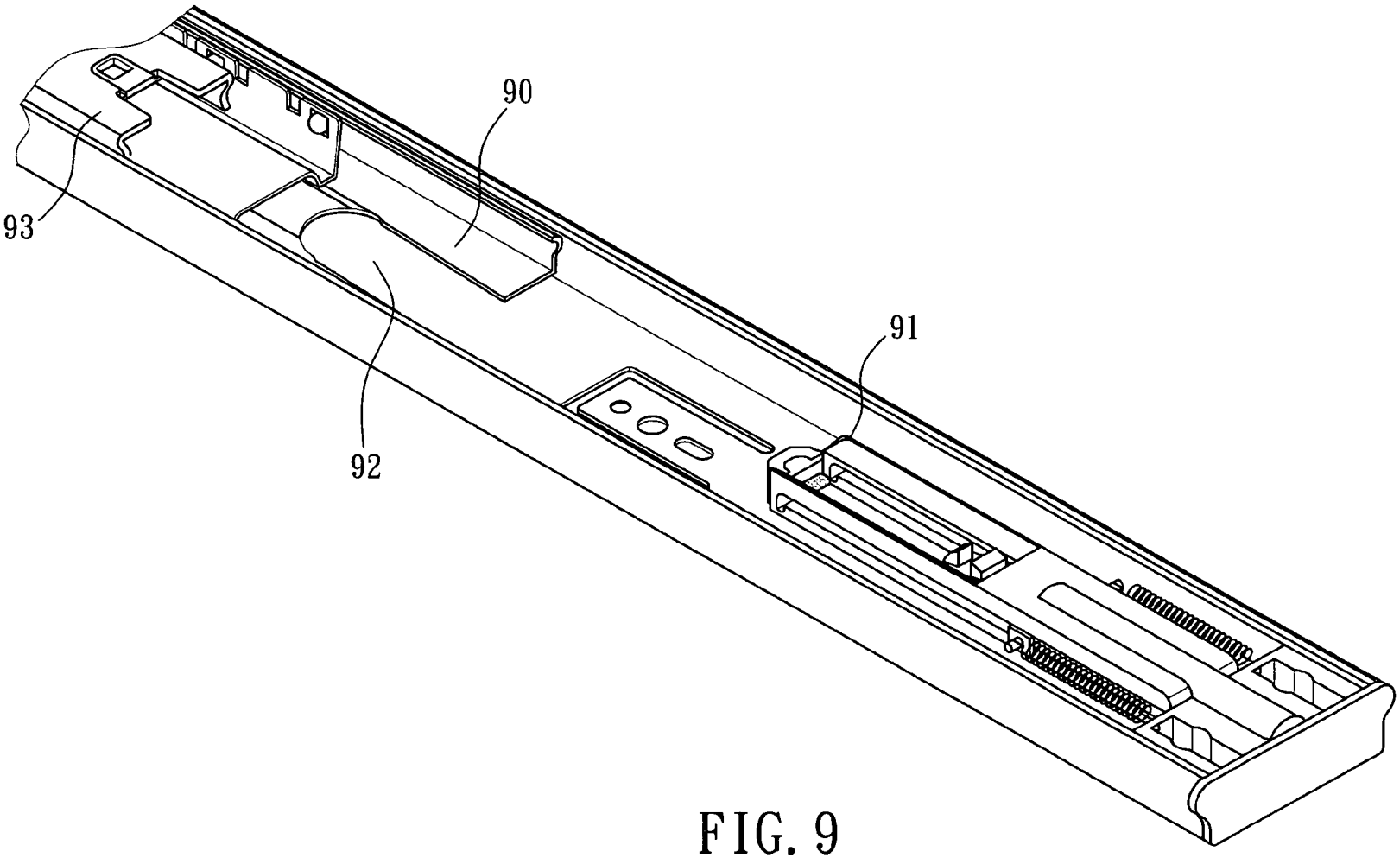
FIG. 9 PRIOR ART
FIG. 9 shows a conventional rail assembly.

FIGS. 7 and 8 show another embodiment of the present invention, wherein the second rail 20 in the first embodiment is omitted and only the third rail 30 is slidably engaged within the first space 11. The third space 31 is sized such that the extension rail 412 is received therein so that the two sidewalls of the third rail 30 can be moved within the grooves 416 in the fixed member 41.

While we have shown and described the embodiment in accordance with the present invention, it should be clear to those skilled in the art that further embodiments may be made without departing from the scope of the present invention.

What is claimed is:

1. A rail assembly comprising:

a substantially U-shaped first rail having two sidewalls and a first space defined between the two sidewalls;

a substantially U-shaped rail movably received in the first space and including two sidewalls with a second space defined between the two sidewalls of the second rail, an escape space defined inward from an underside of the second rail;

a substantially inverted U-shaped third rail movably received in the second space; and a retrieving unit including a fixed member which is fixedly located in an end of the first rail and received in the first space, an extension rail extending from the fixed member and located in the first space, a movable member slidably connected to the extension rail, the extension rail being sized to be received in the escape space of the second rail, the movable member including two upright sides and the two sidewalls of the third rail being guide by two respective insides of the two upright sides, two groove defined in a top on two sides of the fixed member and the two sidewalls of the third rail slidably engaged with the grooves, a connection member located on a top of the movable member and the third rail disengageably engaged with the movable member by the connection member, the connection member including a first protrusion and a second protrusion extending from an underside of two ends thereof.

2. The assembly as claimed in claim 1, wherein at least one spring is located at one of the two sides of the fixed member and connected to the movable member.

3. The assembly as claimed claim 1, wherein the fixed member includes a stop rod and the movable member is stopped by the stop rod.

4. The assembly as claimed in claim 1, wherein a positioning slot is connected to a distal end of the extension rail and the movable member is removably positioned on the positioning slot.

5. A rail assembly comprising:

a substantially U-shaped first rail having two sidewalls and a first space defined between the two sidewalls;

a substantially inverted U-shaped third rail movably received in the first space and including two sidewalls between which a third space is defined; and a retrieving unit including a fixed member which is fixedly located in an end of the first rail and received in the first space, an extension rail extending from the fixed member and located in the first space, a movable member slidably connected to the extension rail, the extension rail being sized to be received in the third space of the third rail, the movable member including two upright sides and the two sidewalls of the third rail being guide by two respective insides of the two upright sides, two grooves defined in a top on two sides of the fixed member and the two sidewalls of the third rail slidably engaged with the grooves, a connection member located on a top of the movable member and the third rail disengageably engaged with the movable member by the connection member, the connection member including a first protrusion and a second protrusion extending from an underside of two ends thereof.

6. The assembly as claimed in claim 5, wherein at least one spring is located at one of the two sides of the fixed member and connected to the movable member.

7. The assembly as claimed in claim 5, wherein the fixed member includes a stop rod and the movable member is stopped by the stop rod.

8. The assembly as claimed in claim 5, wherein a positioning slot is connected to a distal end of the extension rail and the movable member is removably positioned on the positioning slot.

* * * * *